United States Patent [19]

Sullivan

[11] 4,143,996

[45] Mar. 13, 1979

[54] HYDRAULIC CONTROL SYSTEM AND METHOD

[75] Inventor: Richard N. Sullivan, Tempe, Ariz.

[73] Assignee: The Garrett Corporation, Los Angeles, Calif.

[21] Appl. No.: 754,053

[22] Filed: Dec. 23, 1976

[51] Int. Cl.[2] ..... F04B 49/00

[52] U.S. Cl. ..... 417/15; 417/47

[58] Field of Search ..... 417/46, 47, 21, 15, 417/222, 18, 20, 34, 213, 218; 60/452, 431

[56] References Cited

U.S. PATENT DOCUMENTS

| | | | |
|---|---|---|---|
| 1,685,868 | 10/1928 | Schleyer | 417/21 X |
| 2,816,507 | 12/1957 | Gore | 417/218 X |
| 2,942,421 | 6/1960 | Hann et al. | 417/34 |
| 3,060,858 | 10/1962 | Shoosmith | 417/15 X |
| 3,864,059 | 2/1975 | Smith | 417/34 X |

*Primary Examiner*—Carlton R. Croyle
*Assistant Examiner*—Leonard E. Smith
*Attorney, Agent, or Firm*—James W. McFarland; Albert J. Miller

[57] ABSTRACT

A hydraulic control system incorporating a variable displacement, pressure compensated hydraulic pump and means for varying the speed of the input shaft driving the variable displacement pump in proportion to the displacement of the pump.

21 Claims, 2 Drawing Figures

HYDRAULIC CONTROL SYSTEM AND METHOD

BACKGROUND OF THE INVENTION

This invention relates to hydraulic control systems, and relates more particularly to pressure compensated type hydraulic control systems.

In certain applications of hydraulic power systems, pressure compensated variable displacement pumps have found utility by reducing the volume of flow discharged by the pump, and consequently the power required to operate the pump, whenever the hydraulic flow requirements are substantially reduced. In aircraft, for instance, the major demand upon the hydraulic system occurs during landing and takeoff when landing gear, flaps, etc. are operated. Throughout the remainder of the flight the hydraulic flow demand requirements are substantially lower. The pressure compensated pump automatically reduces its displacement in relation to the flow demand requirements to reduce the power consumed during this essentially "standby" condition. A drawback to such a system however is that the pump is still operating at a relatively high, constant, speed and significant standby power consumption by the pump still occurs. Examples of prior art hydraulic systems are found in U.S. Pat. No. 1,576,153; 1,863,406; 2,425,958; 2,694,979; 2,752,858; and 2,961,964.

It is a primary object of the present invention to provide an improved hydraulic power system and method which utilizes not only a pressure compensated pump to vary the flow developed by the pump in relation to the demand requirements of the hydraulic system, but which also substantially varies the rotational speed of the pump in relation to the demand requirements to significantly reduce the power consumed by the hydraulic system when operating at less than maximum power demand.

More particularly, it is an important object of the present invention to provide a pressure compensated pump which includes method and apparatus for sensing pump displacement and varying the input shaft speed to the pump in relationship to pump displacement.

These and other objects and advantages of the present invention are specifically set forth in or will become apparent from the following detailed description of preferred forms of the invention when read in conjunction with the accompanying drawing.

DETAILED DESCRIPTION OF THE PREFERRED EMBODIMENTS

Figure 1:
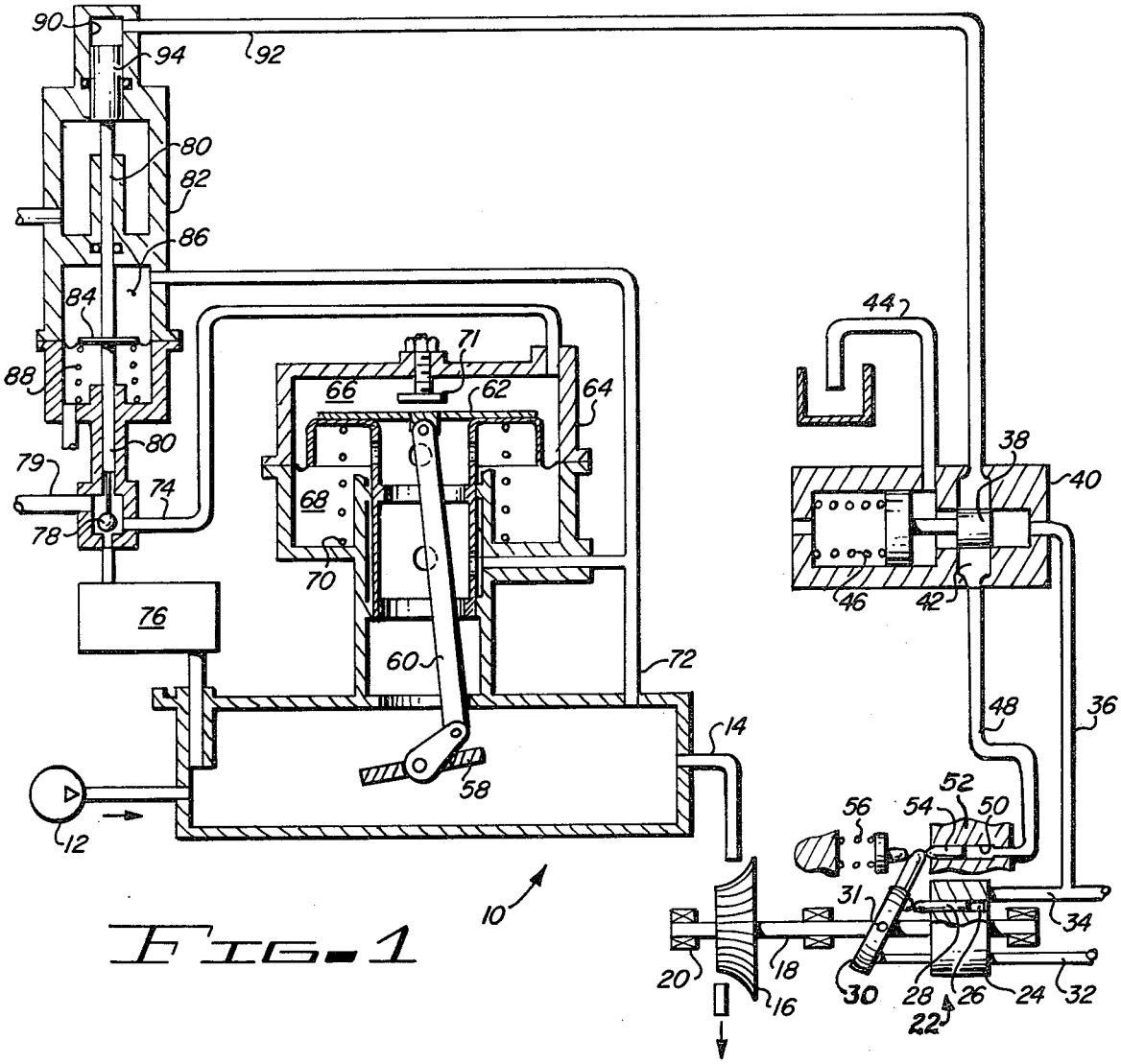
FIG. 1 is a schematic representation of a hydraulic control system constructed in accordance with the principles of the present invention.

Referring now more particularly to FIG. 1, a hydraulic control system generally denoted by the numeral 10 includes a source of pressurized gas 12 delivering pressurized gas flow through a conduit 14 to a rotary fluid turbine in the form of a centrifugal inflow gas turbine 16. Turbine 16 powers a rotary input shaft 18 appropriately mounted on bearings 20 to drive a variable displacement hydraulic pump generally denoted by the numeral 22. The pump 22 illustrated is of the axial piston type incorporating a cylinder barrel 24 operably driven by a shaft 18, and having a plurality of cylinders 26 therein. Mounted within each cylinder 26 is a piston 28 whose outer end is engageable within inclinable swash plate 30. Upon rotation of barrel 24, the pistons 28 move outwardly with respect to their associated cylinders 26 during one-half of the revolution to draw in liquid flow from an input conduit 32, and during the other half of the revolution the pistons 28 shift inwardly into the associated cylinders 26 to displace pressurized hydraulic liquid flow through an output port and conduit 34.

Pump 22 is of the pressure compensated type and includes a feedback control system comprising a conduit 36 communicating with output port 34, and a pressure reducing valve 38 which is oppositely shiftable within a housing 40 to control communication of an output passage 42 with either the pressurized output flow from the pump and conduit 36, or a low pressure reservoir drain 44. A biasing spring 46 urges valve 38 rightwardly to communicate passage 42 with drain 44 and reduce the pressure maintained in passage 42, while pressure from the output 34 of the pump acts directly upon valve 38 to shift the latter leftwardly to connect passage 42 with conduit 36 and increase the pressure in passage 42.

Passage 42 communicates through a conduit 48 with a cylinder 50 defined within a housing 52, and an actuating piston 54 moves in response to the pressure developed in cylinder 50. A helical coil compression spring 56 engages inclinable swash plate 30 to rotate the latter in a generally clockwise direction about its bearing 31 to increase pump displacement, in opposition to the hydraulic force created upon piston 54 by pressure in chamber 50. Characteristically, spring 56 exerts a variable force upon swash plate dependent upon the degree of compression of spring 56. Thus, the force exerted by spring 56 substantially increases as swash plate 30 rotates counterclockwise to a position reducing displacement of pump 22. The feedback control provided by conduit 36, valve 38, and piston 54 automatically develops a pressure within passage 42 and cylinder 50 that substantially balances the variable force exerted by compression spring 56 and adjusts the displacement of pump 22 to maintain a substantially constant output pressure in conduit 34. It is important to note that the feedback system develops a hydraulic pressure in passage 42 whose value is indicative of and varies substantially inversely in relation to the position of swash plate 30 and the displacement of pump 22. Such an arrangement of variable displacement pump 22 in combination with a pressure compensating feedback control including pressure reducing valve 38 is well known, an example being Sperry-Vickers model PV3-240 pressure compensated pump.

Control system 10 further includes an element for controlling the speed of rotation of shaft 18 in the form of a butterfly gas flow control valve 58 interposed in conduit 14. Butterfly 58 is operably connected through appropriate linkage 60 to a diaphragm 62 which traverses the interior of a housing 64 to divide the interior into opposed gas fluid chambers 66 and 68. A biasing spring 70 urges diaphragm 62 upwardly toward an adjustable limit stop 71 whose position is externally adjustable via the nut associated therewith. Pressure of gas flow downstream of butterfly valve 58 is transmitted through conduit 72 into chamber 68 to exert a pneumatic force on the diaphragm assisting spring 70 and urging valve 58 to move toward a more closed position reducing rate of gas flow to turbine 16 and thereby reducing the speed of rotation of shaft 18.

An opposing force on diaphragm 62 is created by higher pressurized gas flow transmitted to chamber 66 from conduit 14 at a location upstream of valve 58, across a pilot pressure regulator 76, a three-way pneumatic control valve 78, and a conduit 74. Valve 78 includes a vertically shiftable plunger 80 which effectively controls fluid communication of conduit 74 with both the higher pressure conduit 14 and low pressure exhaust passage 79. Plunger 80 is vertically adjustable within a housing 82 having a diaphragm 84 traversing a portion of the interior thereof to define a closed gas receiving chamber 86 communicating with conduit 72. A spring 88 exerts a force on diaphragm 84 opposing the pneumatic force created by gas in chamber 86.

At the upper end of housing 82 there is formed an interior liquid receiving chamber 90 communicating with passage 42 through an appropriate conduit 92. A piston 94 carried at the upper end of plunger 80 is vertically movable within chamber 90 in response to the liquid pressure developed in passage 42 and chamber 90.

In operation of the FIG. 1 system, pressurized gas flow from source 12 which, for instance, may be the bleed air flow from a turbofan engine in an aircraft, is metered by butterfuly valve 58 and delivered to conduit 14 to effect rotation of turbine 16 and shaft 18. In response, the variable displacement hydraulic pump 22 draws in liquid at low pressure from its intake conduit 32, and delivers pressurized hydraulic fluid flow through its output port 34. Once output pressure from the pump reaches a preselected level, the hydraulic force exerted upon pressure reducing valve 38 is sufficient to urge valve 38 leftwardly and deliver pressurized liquid through conduits 48 and 92 to liquid chambers 50 and 90 respectively. In response, swash plate 30 is rotated until a position is reached wherein the output flow capacity of the pump substantially matches the hydraulic control system demand requirements as evidenced by establishing a substantially constant output pressure from the pump. In accomplishing this, the pressure regulating valve 38 establishes a pressure in passage 42 and chamber 50 which substantially balances the variable force exerted by the linear gradient spring 56. In so doing, a characteristic pressure is developed in passage 42 dependent upon the angular position of swash plate 30 and thus the displacement of pump 22. A typical application of the system for instance, develops a pressure in passage 42 which varies from approximately 600 psi to approximately 1000 psi as swash plate 30 shifts from its maximum displacement position illustrated to a minimum displacement position wherein swash plate 30 is approximately perpendicular to piston 28. Thus, the pressure developed in passage 42 is indicative of the angular position of swash plate 30 and the displacement of pump 22, varying substantially inversely thereto.

This characteristic pressure also exerts a hydraulic force on piston 94 to variably position plunger 80 in relation to the pump displacement. For instance, as pump displacement decreases and pressure in passage 42 and chamber 90 accordingly increases, plunger 80 is shifted downwardly in FIG. 1 to increase flow from conduit 74 to conduit 79 and reduce the pneumatic pressure maintained in chamber 66. As a result, the force of spring 70 and pressure of gas in chamber 68 rotates butterfly valve 58 to a more closed position to reduce gas flow to turbine 16. Accordingly, the speed of rotation of shaft 18 reduces as pump displacement reduces. In this manner, it will be seen that the present invention provides an improved control system wherein the speed of rotation of shaft 18 is varied in relation to, and preferably substantially directly proportional to the displacement of pump 22. Accordingly, in essentially standby condition wherein the hydraulic flow demand is at a minimum and the pump swash plate 30 is stroked to a substantially perpendicular position to minimize pump displacement, speed of rotation of shaft 18 also substantially reduces in order to minimize the power consumed in operating pump 22 in the standby condition. In this manner, the invention affords greater safety particularly in aircraft applications, since it becomes practical and efficient to permit a plurality of pumps such as pump 22 to operate while in a standby condition with minimum power consumption. A substantial increase in operating efficiency throughout the cycle of operation of the aircraft is also realized.

In conjunction with the controls of the present invention, conventional flow controls can be incorporated. For instance, the system illustrated includes pneumatic pressure balance controls effected by the delivery of pneumatic gas flow to chambers 66 and 68 from opposite sides of butterfly valve 58. Accordingly, the diaphragm 62 is operable to normally maintain the gas flow through conduit 14 at a substantially constant level, yet capable of being overridden by a significant change in liquid pressure developed within chamber 90. A further control included in the system illustrated is a maximum pressure control in the form of the pressurized gas flow delivered to chamber 86 to oppose the force created by compression spring 88. If, for instance, the absolute pressure of gas being delivered to turbine 16 becomes excessively high, diaphragm 84 is shifted downwardly against the urgings of spring 88 to restrict the flow of pressurized gas into conduit 74 and thus cause the butterfly 58 to shift to a more closed position and prevent over pressurization in conduit 14 and/or over speed of shaft 18.

Figure 2:
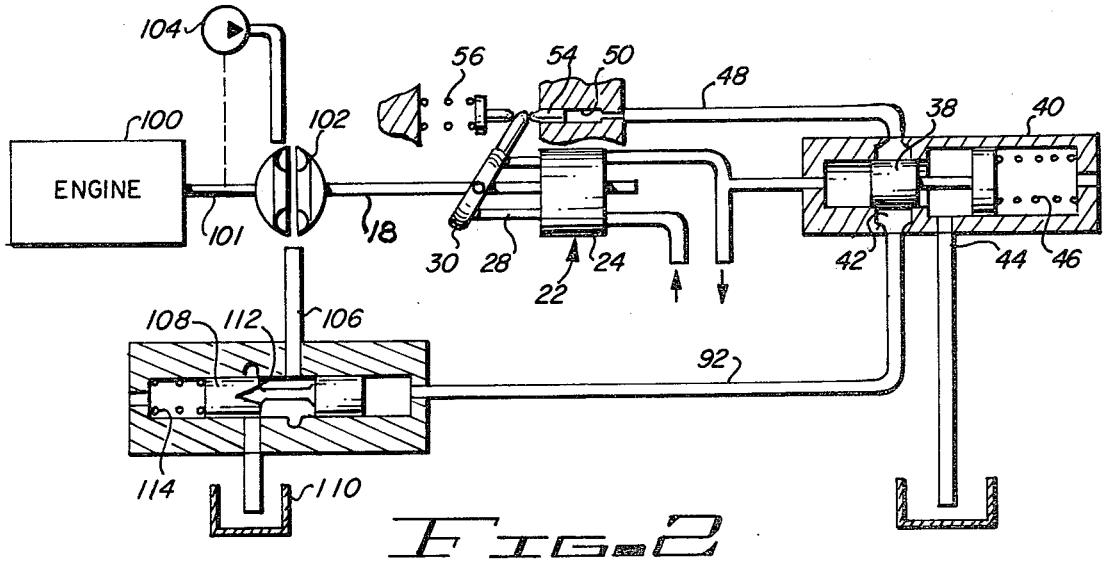
FIG. 2 is a schematic representation of another form of hydraulic control system contemplated by the present invention.

FIG. 2 illustrates a modified form of the system contemplated by the present invention which incorporates a substantial number of the same elements as depicted and described in detail above with respect to FIG. 1 as denoted by utilization of like numerals for like elements. In contrast to the FIG. 1 arrangement, however, the FIG. 2 arrangement contemplates a drive for shaft 18 which includes a shaft 101 mechanically driven by a prime mover engine 100. Shafts 101 and 18 are respectively input and output shafts of a conventional hydraulic torque converter 102. This system further includes a hydraulic fluid supply pump 104 which delivers fluid to fill the torque converter 102. Fluid from the torque converter is drained through an exhaust conduit 106 and across metering valve 108 to a low pressure reservoir 110.

As well known within the art, torque converter 102 transmits a varying quantity of torque to shaft 18 to operate it at different speeds, all dependent upon the volume of hydraulic fluid contained within the torque converter. The present invention contemplates the variable control of fluid exhaust from torque converter 102 to effect change of speed of shaft 18. To this end, the conduit 92 communicating with the passage 42 of the hydraulic feedback control of the pressure compensator pump 22 is delivered to operate directly against valve 108 in opposition to a biasing spring 114. Valve 108 is laterally shiftable back and forth such that its metering notch 112 can variably control the rate of exhaust flow from torque converter 102 to reservoir 110.

In operation of the FIG. 2 arrangement, at high pump displacements where swash plate 30 is stroked to a high inclination as illustrated, pressure in passage 42 is at a minimum thereby allowing valve 108 to be shifted to a rightward location placing a substantial restriction to exhaust flow from torque converter 102. Accordingly, the torque converter 102 remains substantially filled and maximum torque is delivered to drive shaft 18 at a maximum speed. As pump displacement decreases when swash plate 30 is stroked to a more vertical inclination, pressure in passage 42 builds to a higher level as described previously with respect to FIG. 1, and valve 108 accordingly shifts leftwardly to allow greater exhaust flow from torque converter 102. The volume of hydraulic fluid thus maintained within converter 102 substantially reduces to reduce the amount of torque delivered to shaft 18 and substantially lower the speed of shaft 18. Accordingly it will be seen that the FIG. 2 arrangement operates similarly to the FIG. 1 arrangement in varying the speed of input shaft 18 in relation to the displacement of a pressure compensated pump 22.

From the foregoing it will be apparent that the present invention also contemplates an improved method of controlling a variable displacement hydraulic pump 22 driven by variable speed shaft 18, which includes the steps of sensing pump output pressure in output port 34 as well as sensing the pump displacement as evidenced by the pressure developed in passage 42. Pump displacement is controlled in relation to the output pressure in order to maintain a substantially constant output pump pressure, and the speed of shaft 18 is controlled in relation to the sensed pump displacement.

The foregoing detailed description of preferred forms of the invention should be considered exemplary in nature and not as limiting to the scope and spirit of the invention as set forth in the appended claims.

Having described the invention with sufficient clarity that those skilled in the art may make and use it, I claim:

1. Apparatus for controlling a variable displacement hydraulic pump driven by a variable speed input shaft to develop a pressurized output fluid flow and including an element adjustably positionable to vary pump displacement, comprising:

first sensing means for sensing pressure of said pump output flow;

first control means for adjusting the position of said element in response to said first sensing means;

second sensing means for sensing said position of the element; and second control means responsive to said second sensing means for adjusting the speed of said shaft in proportion to said sensed position.

2. In combination:

a source of pressurized fluid;

a rotary turbine driven by pressurized fluid from said source and having a rotary power output shaft;

a control valve for varying the flow of fluid from said source to said turbine to control the speed of rotation of said shaft;

a variable displacement liquid pump operably driven by said shaft and having a liquid output port;

an element for adjusting the displacement of said pump;

compressible biasing means urging said element in a direction increasing pump displacement and exerting a force on said element which decreases in relation to increase in said pump displacement;

a control cylinder having a liquid chamber and a piston reciprocal within said chamber urging said element in a direction decreasing pump displacement;

a feedback control communicating with said output port and operable to meter liquid flow to said liquid chamber to shift said piston and vary said displacement of the pump to maintain a substantially constant pressure of liquid delivered from said output port, said feedback means developing a variable pressure in said liquid chamber which is indicative of pump displacement; and actuator means responsive to said variable pressure in said liquid chamber for adjusting said control valve to change the speed of rotation of said shaft substantially in proportion to pump displacement.

3. A hydraulic power system comprising:

a source of pressurized gas;

a power input shaft;

a rotary power turbine driven by said source of pressurized gas and operably coupled to drive said shaft;

a control valve for controlling flow of gas from said source to said turbine to vary the speed of said shaft;

a pneumatic actuator having a gas chamber operably coupled to actuate said control valve in relation to the pneumatic pressure in said gas chamber;

a variable displacement hydraulic pump driven by said shaft and having a fluid output port;

pressure sensing means for sensing the hydraulic pressure of fluid delivered from said output port of the pump;

means responsive to said pressure sensing means for adjusting the displacement of said pump to maintain said hydraulic pressure at a substantially constant preselected level;

displacement sensing means for sensing said displacement of the pump; and a three-way valve operably communicating with said source and a low pressure gas return, said three-way valve operably coupled with said displacement sensing means and said gas chamber to control communication of said gas chamber with said source and said low pressure return to vary the magnitude of said pneumatic pressure in the gas chamber in relation to said displacement of the pump whereby said speed of the shaft is varied in relation to said displacement.

4. A method of controlling a variable displacement hydraulic pump driven by a variable speed input shaft and having an element adjustably positionable to vary pump displacement, comprising the steps of:

sensing pump output pressure;

positioning said element in relation to said sensed output pressure;

sensing the position of said element; and controlling input shaft speed in proportion to said sensed position.

5. A method as set forth in claim 4, wherein said position of the element is controlled to maintain a substantially constant, preselected pump output pressure.

6. A method as set forth in claim 5, wherein input shaft speed is controlled by varying motive gas flow to a gas turbine driving said shaft.

7. A method as set forth in claim 6, wherein said input shaft speed is incrementally varied through a range of speeds.

8. A hydraulic power system comprising:

a power input shaft;

a variable displacement hydraulic pump driven by said shaft and having a fluid output port;

a first element variably positionable to adjust the displacement of said pump;

a second element for adjusting the speed of said input shaft;

first control means for sensing pressure of fluid delivered from said output port of the pump and accordingly adjusting the position of said first element to maintain said pressure at a substantially constant preselected level; and second control means for sensing said position of the first element and accordingly operating said second element to adjust said speed of the input shaft in relation to said sensed position.

9. A system as set forth in claim 8, further including a source of pressurized fluid, a rotary power turbine operably coupled to said shaft whereby pressurized fluid delivered from said source to said turbine rotates said shaft, said second element comprising a valve for variably controlling flow from said source to said turbine in relation to said sensed position.

10. A system as set forth in claim 8, further including a hydraulic torque converter operably coupled to deliver a variable amount of power to said shaft in relation to the volume of hydraulic fluid within said torque converter, said second element comprising means for adjusting said volume of hydraulic fluid in said torque converter in relation to said sensed position.

11. A system as set forth in claim 8, wherein said variable displacement hydraulic pump comprises an axial piston pump having a rotary barrel, a plurality of pistons reciprocal within said barrel, said first element comprising an inclinable swash plate engaging said pistons to vary the length of stroke of said pistons in relation to the inclination of said swash plate.

12. A system as set forth in claim 11, wherein said first control means comprises a cylinder defining a fluid control chamber, a piston mounted within said fluid control chamber and engageable with said swash plate to vary the inclination thereof, and a pressure reducing valve operably communicating said fluid control chamber with said output port and a low pressure fluid return, said pressure reducing valve responsive to pressure in said output port to selectively vary the pressure developed within said fluid control chamber whereby said variable pressure in the fluid control chamber is indicative of the inclination of said swash plate.

13. A system as set forth in claim 12, wherein said second control means includes a pressure responsive plunger shiftable to vary the speed of said input shaft, there being a housing defining a cylinder in which said plunger reciprocates, conduit means interconnecting said fluid control chamber and said plunger cylinder, and a spring urging said plunger in opposition to pressure in said plunger cylinder whereby said plunger shifts in relation to the magnitude of said variable pressure developed within said fluid control chamber.

14. A system as set forth in claim 13, further including a source of pressurized gas, a rotary power gas turbine operably coupled to drive said shaft, a first gas conduit for delivering pressurized gas flow from said source to said turbine to rotate said shaft, said second element comprising a control valve operably interposed in said first gas conduit to adjust gas flow delivered from said source to said turbine.

15. A hydraulic power system comprising:

a source of pressurized gas;

a power input shaft;

a rotary power gas turbine operably coupled to drive said shaft;

a first gas conduit for delivering pressurized gas flow from said source to said turbine to rotate said shaft;

a variable displacement hydraulic pump driven by said shaft and having a fluid output port, said pump comprising an axial piston pump having a rotary barrel and a plurality of pistons reciprocal within said barrel;

a first element for adjusting the displacement of said pump comprising an inclinable swash plate engaging said pistons to vary the length of stroke of said pistons in relation to the inclination of said swash plate;

a second element for adjusting the speed of said input shaft comprising a control valve operably interposed in said first gas conduit to adjust gas flow delivered from said source to said turbine;

first control means for sensing pressure of fluid delivered from said output port of the pump and accordingly operating said first element to maintain said pressure at a substantially constant preselected level, said first control means comprising a cylinder defining a fluid control chamber, a piston mounted within said fluid control chamber and engageable with said swash plate to vary the inclination thereof, and a pressure reducing valve operably communicating said fluid control chamber with said output port and a low pressure fluid return, said pressure reducing valve responsive to pressure in said output port to selectively vary the pressure developed within said fluid control chamber whereby said variable pressure in the fluid control chamber is indicative of the inclination of said swash plate;

second control means for sensing said displacement of the pump and accordingly operating said element to adjust said speed of the input shaft in relation to said displacement, said second control means including a cylinder, pressure responsive plunger reciprocal in said cylinder to vary the speed of said input shaft, conduit means interconnecting said fluid control chamber and said cylinder, and a spring urging said plunger in opposition to pressure in said cylinder whereby said plunger shifts in relation to the magnitude of said variable pressure developed within said fluid control chamber; and a housing associated with said control valve, a diaphragm operably coupled to said control valve and traversing said housing to divide the latter into opposing gas chambers, said second control means further including a shiftable three-way carried by said plunger for variably communicating one of said opposing gas chambers with pressurized gas flow in said first gas conduit and a low pressure return whereby to develop a pneumatic pressure in said one of the opposing gas chambers whose magnitude is indicative of the magnitude of pressure in said fluid control chamber.

16. A system as set forth in claim 15, further including a second gas conduit interconnecting the other of said opposing gas chambers with said first gas conduit at a location downstream of said control valve, and spring means in said other of the opposing gas chambers assisting pressure of gas therein in urging said diaphragm to shift in a direction causing said control valve to move in a direction decreasing gas flow to said turbine.

17. A system as set forth in claim 16, further including a stop for limiting travel of said diaphragm in a direction decreasing gas flow through said first gas conduit.

18. A system as set forth in claim 17, further including means for adjusting the position of said stop.

19. In combination:

a source of pressurized fluid;

a rotary turbine driven by pressurized fluid from said source and having a rotary power output shaft;

a control valve for varying the flow of fluid from said source to said turbine to control the speed of rotation of said shaft;

a variable displacement liquid pump operably driven by said shaft and having a liquid output port;

an element for adjusting the displacement of said pump;

compressible biasing means urging said element in a direction increasing pump displacement and exerting a force on said element which decreases in relation to increase in said pump displacement;

a control cylinder having a liquid chamber and a piston reciprocal within said chamber urging said element in a direction decreasing pump displacement;

a feedback control communicating with said output port and operable to meter liquid flow to said liquid chamber to shift said piston and vary said displacement of the pump to maintain a substantially constant pressure of liquid delivered from said output port, said feedback means developing a variable pressure in said liquid chamber which is indicative of pump displacement; and actuator means responsive to said variable pressure in said liquid chamber for adjusting said control valve to change the speed of rotation of said shaft substantially in proportion to pump displacement, said actuator means including a housing, a diaphragm operably coupled to shift said control valve and traversing said housing to divide the latter into opposed fluid receiving chambers, a three-way metering valve for variably metering pressurized fluid flow from said source into and out of one of said opposed fluid chambers to shift said control valve, a spring urging said three-way metering valve in a direction increasing pressure in said one of the opposed chambers to thereby increase the flow of pressurized fluid to said turbine and increase said shaft speed, and means communicating the variable pressure maintained in said liquid chamber to said metering valve whereby said variable pressure exerts a force on said metering valve urging the latter in a direction reducing pressure maintained in said one of the opposed chambers to thereby decrease fluid flow to said turbine and decrease shaft speed.

20. A combination as set forth in claim 19, further including spring means in the other of said opposed chambers urging said diaphragm in a direction decreasing fluid flow to said turbine, and a conduit communicating said other of the opposed chambers with fluid flow being delivered to said turbine at a location downstream of said control valve.

21. A combination as set forth in claim 20, wherein said feedback control includes a pressure reducing valve shiftable in first and second directions to respectively communicate said liquid chamber with said output port and a low pressure drain, there being a spring urging said pressure reducing valve in said first direction, the pressure developed in said output port urging said pressure reducing valve in said second direction.

* * * * *